US010166648B2

(12) United States Patent
Haas et al.

(10) Patent No.: US 10,166,648 B2
(45) Date of Patent: Jan. 1, 2019

(54) FINISHING BELT DEVICE AND METHOD FOR FINISHING A WORKPIECE

(71) Applicant: Supfina Grieshaber GmbH & Co. KG, Wolfach (DE)

(72) Inventors: Alfons Haas, Sankt Roman/Wolfach (DE); Johannes Herrmann, Bad Rippoldsau (DE)

(73) Assignee: SUPFINA GRIESHABER GMBH & CO. KG, Wolfach (DE)

( * ) Notice: Subject to any disclaimer, the term of this patent is extended or adjusted under 35 U.S.C. 154(b) by 0 days.

(21) Appl. No.: 15/343,245

(22) Filed: Nov. 4, 2016

(65) Prior Publication Data

US 2017/0129069 A1 May 11, 2017

(30) Foreign Application Priority Data

Nov. 9, 2015 (DE) ..... 10 2015 221 939

(51) Int. Cl.
*B24B 21/00* (2006.01)
*B24B 21/20* (2006.01)

(52) U.S. Cl.
CPC ..... *B24B 21/002* (2013.01); *B24B 21/20* (2013.01)

(58) Field of Classification Search
CPC ..... B24B 21/20; B24B 21/002
USPC ..... 451/59, 168
See application file for complete search history.

(56) References Cited

U.S. PATENT DOCUMENTS 4,979,335 A * 12/1990 Weber ..... B24B 5/42 451/324
4,993,191 A * 2/1991 Judge ..... B24B 19/12 451/303
5,507,684 A 4/1996 Schwaer
5,651,719 A * 7/1997 Pineau ..... B24B 5/42 451/11
6,102,783 A * 8/2000 Loock ..... B24B 19/12 451/168
6,309,287 B2 * 10/2001 Martin, III ..... B24B 19/12 451/303
6,916,230 B2 * 7/2005 Bonachera ..... B24B 19/12 451/168

(Continued)

FOREIGN PATENT DOCUMENTS

DE 4328006 C1 8/1994
EP 3135433 A2 * 3/2017 ..... B24B 19/125
WO WO 2012065949 A1 5/2012

*Primary Examiner* — George Nguyen
(74) *Attorney, Agent, or Firm* — Leydig, Voit & Mayer, Ltd.

(57) ABSTRACT

A finishing belt device includes a pressure apparatus having a pressure roller that applies a pressing force to the rear side of a finishing belt that, when viewed in the running direction of the finishing belt, an active side of the finishing belt is pressed against a peripheral surface to be finished of a workpiece in a linear contact region at the level of the pressing force. A pressure roller support is provided with the pressure roller arranged as a first pressure roller and another pressure roller is arranged as a second pressure roller. When viewed in the running direction of the finishing belt, the active side of the finishing belt is pressed against the peripheral surface to be finished of the workpiece in two spaced-apart linear contact regions via the two pressure rollers. The invention also relates to a method for finishing a peripheral surface of a cam surface.

18 Claims, 7 Drawing Sheets

(56) References Cited

U.S. PATENT DOCUMENTS

| | | | | |
|---|---|---|---|---|
| 8,517,804 | B2 * | 8/2013 | Weigmann | B24B 21/02 451/168 |
| 9,221,146 | B2 * | 12/2015 | Hildebrandt | B24B 21/20 |
| 2004/0029499 | A1 | 2/2004 | Bonachera et al. | |
| 2006/0252355 | A1 * | 11/2006 | Kumasaka | B24B 9/065 451/44 |
| 2009/0117828 | A1 * | 5/2009 | Hongo | B24B 9/065 451/6 |
| 2012/0252320 | A1 * | 10/2012 | Seki | B24B 21/002 451/28 |

* cited by examiner

FINISHING BELT DEVICE AND METHOD FOR FINISHING A WORKPIECE

CROSS-REFERENCE TO PRIOR APPLICATIONS

Priority is claimed to German Patent Application No. DE 10 2015 221 939.9, filed on Nov. 9, 2015, the entire disclosure of which is hereby incorporated by reference herein.

FIELD

The invention relates to a finishing belt device comprising a pressure apparatus having a pressure roller that applies a pressing force to the rear side of a finishing belt such that, when viewed in the running direction of the finishing belt, an active side of the finishing belt can be pressed against a peripheral surface, that is to be finished, of a workpiece in a linear contact region at the level of the pressing force.

BACKGROUND

A finishing belt device of this type is known from WO 2012/065949 A1 (FIGS. 2, 4 and 7 therein). Within the meaning of the present invention, the expression "linear contact region" is used to create a distinction from arrangements in which a finishing belt winds around part of the workpiece peripheral surface (see for example FIG. 8 in WO 2012/065949 A1).

When finishing a workpiece by means of a finishing belt, a workpiece to be machined is rotated about an axis of rotation. The active side of a finishing belt is pressed against a rotating peripheral surface, that is to be finished, of the workpiece. In the process, a translational oscillating movement is superposed on the rotational movement of the workpiece. In this case, the finishing belt and the workpiece move back and forth relative to one another in a direction parallel to the axis of rotation. This thus produces a cross-grinding structure characteristic of the finishing method.

It has been found that it can be difficult to machine a workpiece peripheral surface that does not have a rotationally symmetrical geometry, for example cam peripheral surfaces of a cam shaft. The aim is for the cam peripheral surface to be machined to a consistently high surface quality along the entire periphery. The problem here, however, is that the finishing belt has to be prevented from lifting off from the cam peripheral surface being rotated. To ensure this in practice, relatively low rotational speeds are usually selected. However, these low rotational speeds lead to longer machining times.

SUMMARY

On this basis, the problem addressed by the present invention is to provide a finishing belt device by which cam peripheral surfaces of a workpiece can be finished to a high quality and in short machining times.

With a finishing belt device of the type mentioned at the outset, this problem is solved according to the invention in that a pressure roller support is provided, on which the pressure roller is arranged as a first pressure roller and another pressure roller is arranged as a second pressure roller, such that, when viewed in the running direction of the finishing belt, the active side of the finishing belt can be pressed against the peripheral surface, that is to be finished, of the workpiece in two spaced-apart linear contact regions by means of the two pressure rollers.

Within the scope of the invention, the same peripheral surface of a workpiece, in particular a cam peripheral surface, can be finished by the active side of the finishing belt in two linear contact regions at the same time. By arranging the two pressure rollers on one pressure roller support, the two pressure rollers can be operated together. This makes it easier to operate the pressure apparatus, since the two pressure rollers remain in linear contact with the peripheral surface of the workpiece. Owing to the double contact of two pressure rollers with the same peripheral surface of the workpiece, it is possible to counteract the tendency of a pressure roller to lift off from the peripheral surface when machining a cam portion.

Therefore, the finishing belt device according to the invention allows for a surface quality that remains constant along the periphery of the workpiece peripheral surface to be machined and which can also be achieved in relatively short machining times.

Within the meaning of the present invention, the expression "linear contact region" means that the finishing belt is in contact with the peripheral surface over the width of the finishing belt (corresponding to the "length" of the line) and that, when viewed in the running direction of the finishing belt, the contact region is narrow (corresponding to the "width" of the line, which is greater than 0 mm but preferably smaller than 3 mm, in particular smaller than 2 mm) because of the curvature of pressure roller pressing surface in the opposite direction to the workpiece peripheral surface. In practice, the "width" of the line is dependent on the radius of the workpiece peripheral surface to be machined, the radius of a pressure roller, the flexibility of the finishing belt used, and the flexibility of the pressure rollers. The pressure rollers can consist of a relatively rigid, metal material, thus producing a relatively narrow contact region. The pressure rollers can also consist of a resiliently flexible plastics material, thus producing a narrower contact region (within the limits stated above).

When viewed in the running direction of the finishing belt, between the linear contact regions the active side of the finishing belt is preferably at a spacing from the workpiece peripheral surface to be finished.

In a particularly preferred embodiment, when viewed in the running direction of the finishing belt, a first deflection roller that acts between the pressure rollers is provided and spaces the finishing belt apart from the peripheral surface to be finished at the level of the deflection roller. The deflection roller has a guide function for the path of the finishing belt. Since the deflection roller is rotatable about a deflection roller axis, the finishing belt can also be conveyed without friction in the region of the deflection roller.

It is particularly preferable to arrange the first deflection roller on the pressure roller support. Two pressure rollers and the first deflection roller can thus be operated together.

It is also particularly preferable for the pressure roller support to be held on a main support so as to be rotatable about a pivot axis. This makes it simple to provide a degree of freedom when machining a peripheral surface that does not have a rotationally symmetrical geometry.

The aforementioned pivot axis preferably extends in parallel with an axis of rotation of the aforementioned deflection roller. This makes it possible to guide the finishing belt in a simple and twist-free manner.

In particular, the pivot axis of the pressure roller support and the axis of rotation of the first deflection roller extend coaxially. This makes it possible to minimize movement of the finishing belt when machining a cam peripheral surface.

It is also preferable for the main support to be able to be pressed towards the workpiece along an axis radial to a workpiece axis by means of a pressing apparatus. The pressing apparatus exerts a force on the main support that is transmitted from the main support to the two pressure rollers via the pressure roller support. Preferably, the pressing apparatus is flexible in an opposite direction, i.e. in a direction away from the workpiece, such that the main support, the pressure roller support and the two pressure rollers can retreat when a cam portion further away from a workpiece axis is being machined.

The pressing apparatus can, for example, be a pneumatic cylinder. It is possible for the pressing apparatus to also take on an advance function in order to position the pressure apparatus relative to the workpiece. Alternatively, an advance apparatus separate from the pressing apparatus can also be provided.

To further improve the guidance of the finishing belt, at least one additional deflection roller is provided between a finishing belt supply and the first pressure roller and/or between the second pressure roller and a finishing belt collection apparatus in the running direction of the finishing belt. If there is an additional deflection roller, it is likewise preferable for it to be arranged on the pressure roller support.

Particularly preferably, the at least one additional deflection roller deflects the finishing belt adjacently to or at the height of a plane that extends in parallel with the axes of rotation of the pressure rollers in such a way that the two pressure rollers are arranged on different sides of the plane. In this way, the forces acting in the running direction of the finishing belt for conveying the finishing belt onwards are largely decoupled from a movement of the pressure roller support. This is the case in particular when the two pressure rollers are spaced apart from said plane at least substantially by the same amount.

According to another preferred embodiment, a finishing belt conveying apparatus is provided, which exerts a tensile force on the finishing belt and holds the finishing belt under tension and conveys it onwards. In particular, the finishing belt is continuously conveyed onwards, when viewed in the running direction of the finishing belt, such that a constantly changing portion of the active side of the finishing belt is provided while a peripheral surface is being machined in the linear contact regions.

A preferred finishing belt conveying apparatus is designed as a motor-driven finishing belt collection roller. This roller is arranged in particular on a main support of the finishing belt device.

It is possible for the two linear contact regions to each extend in a straight line, the lengths of each line corresponding to the width of the finishing belt. For this purpose, it is preferable to use circular-cylindrical pressure rollers. However, it is also possible for at least one of the pressure rollers to have a shape different from a circular-cylindrical shape, in particular a concave or convex shape, such that the corresponding linear contact region of the finishing belt differs from a straight line and in particular has a curved course.

In this way, peripheral surfaces curved in multiple dimensions can be finished in a simple manner.

The finishing belt device preferably comprises a rotary drive for rotating the workpiece about an axis of rotation.

It is also preferable for the pressure roller support and/or the workpiece to be finished to be able to be driven in an oscillating manner in a direction parallel to the axis of rotation by means of an oscillating drive.

In one aspect, the invention contemplates a finishing belt device for finishing a peripheral surface of a workpiece, including a finishing belt including a rear side and an active side. A pressure apparatus including a pressure roller is configured to apply a pressing force to the rear side such that, when viewed in the running direction of the finishing belt, the active side is pressed against the peripheral surface in a linear contact region at the level of the pressing force. A pressure roller support on which the pressure roller is arranged as a first pressure roller is provided and another pressure roller is arranged as a second pressure roller, such that, when viewed in the running direction of the finishing belt, the active side of the finishing belt is pressed against the peripheral surface of the workpiece in two spaced-apart linear contact regions via the first and second pressure rollers.

The present invention also includes a method by which cam peripheral surfaces of a workpiece can be finished to a high quality and in short machining times. In particular the method includes wherein the active side of the finishing belt is pressed against the peripheral surface, that is to be finished, of the workpiece in two spaced-apart linear contact regions by the two pressure rollers

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
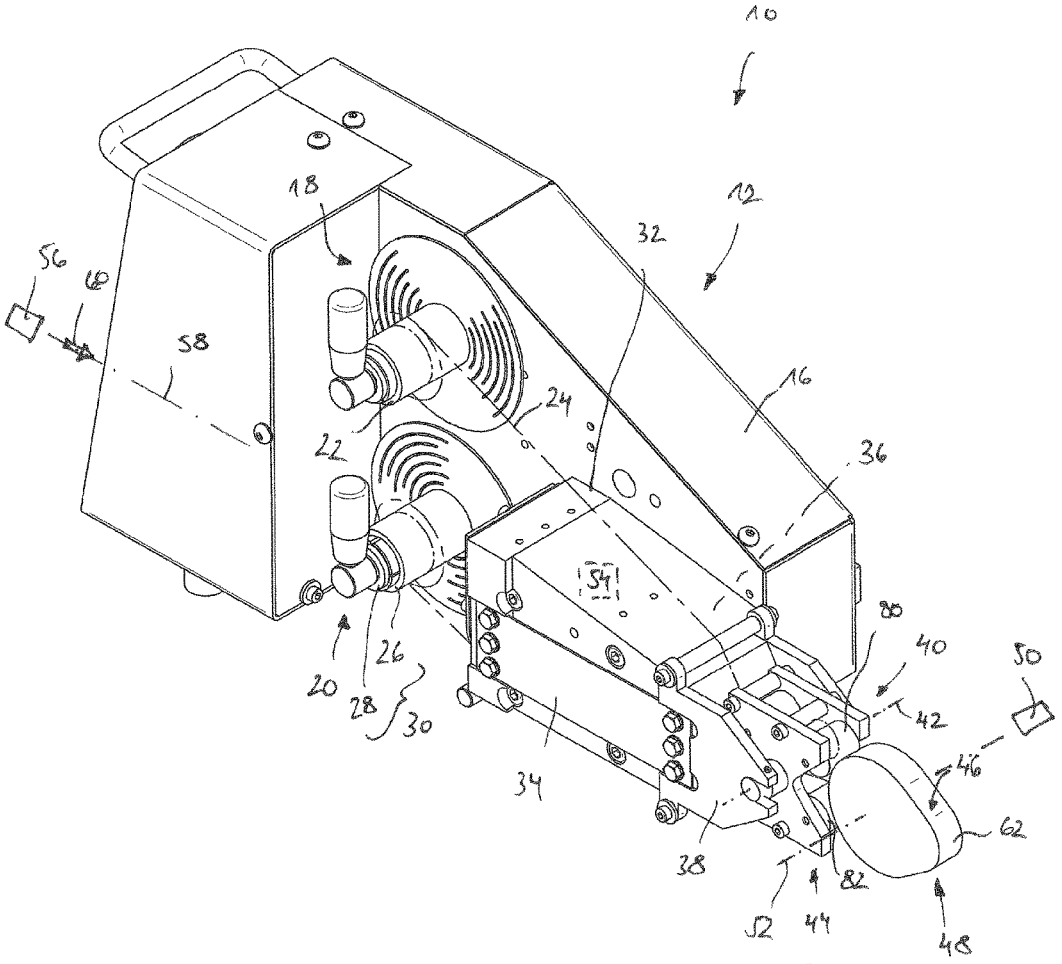
FIG. 1 is a perspective front view of an embodiment of a finishing belt device.

In the drawings, an embodiment of a finishing belt device is denoted in general by reference numeral 10.

Figure 2:
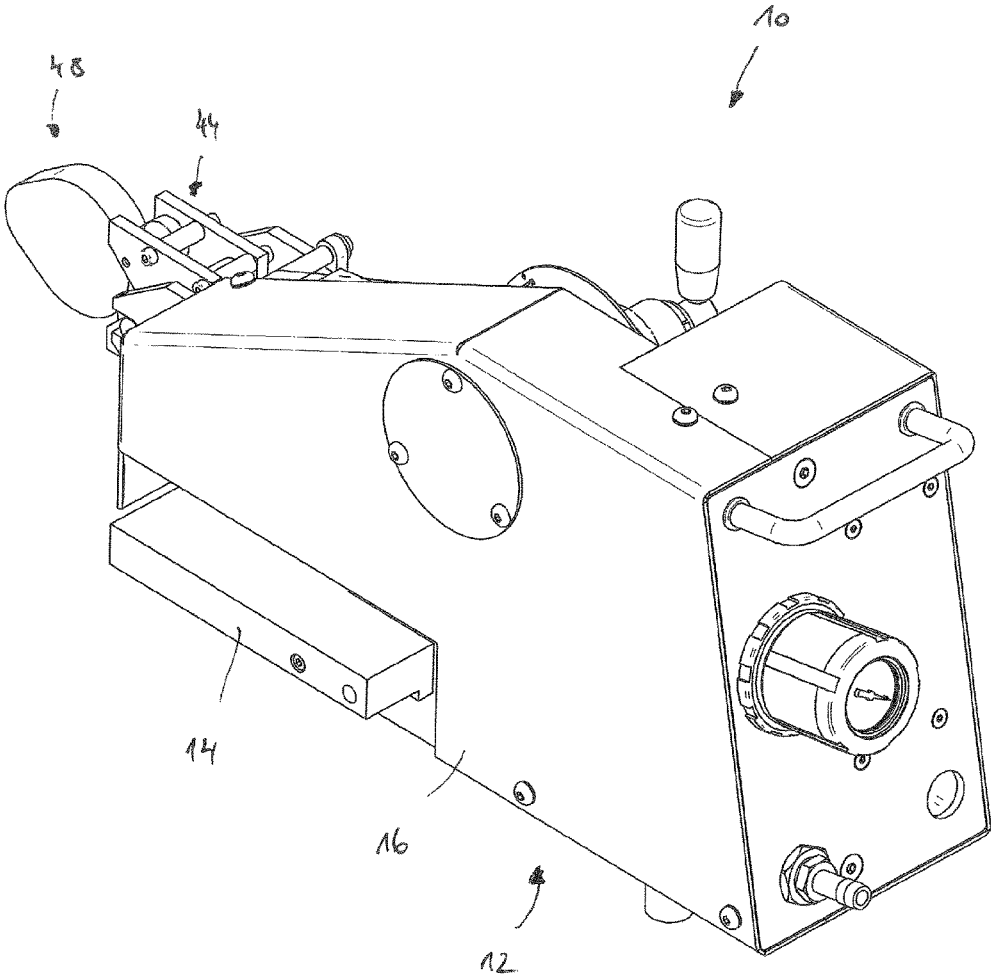
FIG. 2 is a perspective view from the rear of the finishing belt device according to FIG. 1.

The device 10 comprises a main support 12, which can be connected to either the frame or machine bed of a machine tool by means of a connecting portion 14 (cf. FIG. 2).

The main support 12 comprises a housing 16 that is used in particular for arranging a finishing belt supply 18 and a finishing belt collection apparatus 20.

The finishing belt supply 18 comprises a supply roller 22, on which fresh finishing belt 24 is wound and stored.

The finishing belt collection apparatus 20 comprises a finishing belt collection roller 26 for winding up used finishing belt 24. The finishing belt collection roller 26 is driven by means of a motor drive 28. Together, the drive 28 and the finishing belt collection roller 26 form a finishing belt conveying apparatus 30.

The main support 12 further comprises a holder 32 that is connected to the housing 16 and to which back ends of a pair of leaf springs 34, 36 are fastened. The front ends of the leaf springs 34, 36, which ends are spaced apart from the rear ends, are connected to a holding portion 38 for a pressure apparatus 40.

The holding portion 38 defines a pivot bearing having a pivot axis 42 for a pressure roller support 44, which is thus mounted on the holding portion 38 of the main support 12 so as to be rotatable about the pivot axis 42.

The pressure apparatus 44 is used to apply a pressing force to the rear side of the finishing belt such that an active side on the front of the finishing belt 24 is pressed against a peripheral surface 46 of a workpiece 48. The workpiece 48 is in particular a cam shaft, of which a cam is shown by way of example in the drawings.

As is known per se, the workpiece 48 is held in a workpiece holder (not shown) (for example a spindle head or a tailstock) and can be rotated about a workpiece axis 52 by means of a rotary drive 50.

The finishing belt device 10 further comprises an oscillating drive 54 (cf. also FIG. 5*a*) that is connected to the holder 32 and interacts with the holding portion 38 by means of a driven element (e.g. an eccentric) such that the holding portion 38 and the pressure apparatus 44 rotatably mounted thereon can be driven back and forth in a direction parallel to the axis of rotation 52. The stroke here is comparatively small and extends to the height of the holding portion 38 and tangentially to the back ends of the leaf springs 34 and 36.

The finishing belt device 10 further comprises a pressing apparatus 56, which is in the form of a pneumatic cylinder for example. The pressing apparatus 56 exerts a contact pressure 60 on the main support 12 along an axis 58 radial to the workpiece axis 52. The pressing apparatus 56 is flexible in the direction counter to the contact pressure 60. In this way, the finishing belt 24 on which force is applied by the pressure apparatus 44 remains in contact with the peripheral surface 46 of the workpiece 48 when the finishing belt 24 comes into contact with a cam portion 62 of the workpiece 48, since the main support 12 retreats together with the holding portion 38 and the pressure apparatus 40 in the direction counter to the contact pressure 60.

It is possible for the connecting portion 14 of the housing 16 to be part of a linear guide. It is also possible for the connecting portion 14 to be connected to a carriage that gives the connecting portion 14 and thus also the main support 12 the ability to move in a direction parallel to the axis 58.

Figure 3:
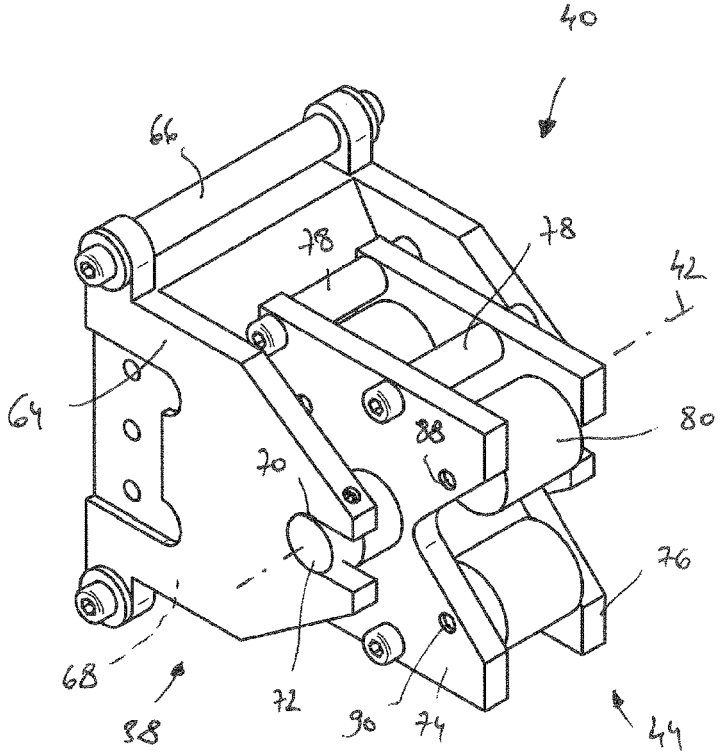
FIG. 3 is a perspective view of a pressure apparatus of the finishing belt device according to FIG. 1.
Figure 4:
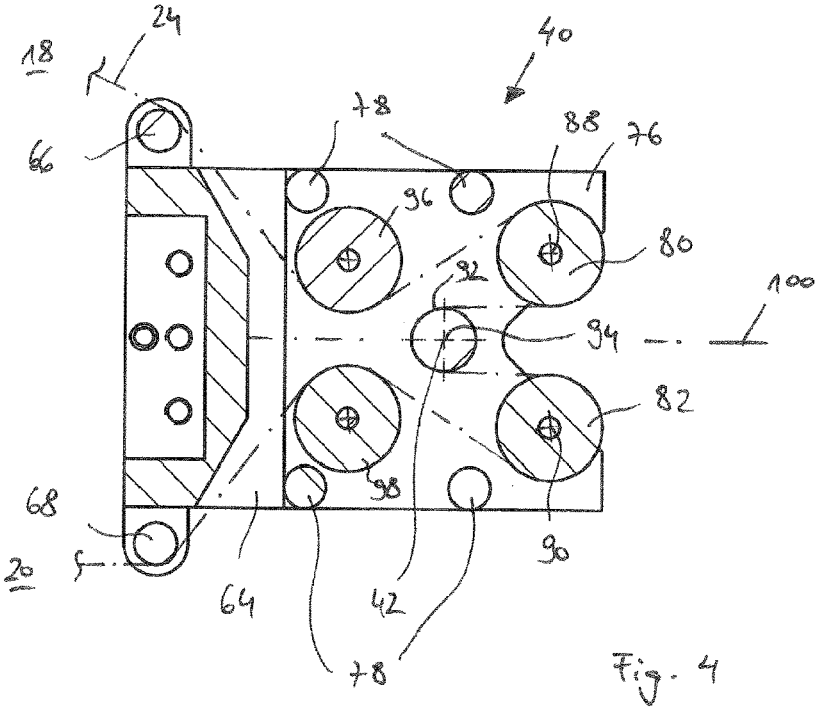
FIG. 4 is a side view of the pressure apparatus according to FIG. 3 along a vertical sectional plane.

In the following, the holding portion 38 and the pressure apparatus 40 will be described with reference to FIGS. 3 and 4. The holding portion 38 comprises a U-shaped bracket 64, to which guide rods 66 and 68 are fastened. These are used to guide the finishing belt 24 from the finishing belt supply 18 to the finishing belt collection apparatus 20.

At its front side facing the workpiece 48, the bracket 64 comprises a pivot bearing 70 for a pin 72 of the pressure apparatus 40, which pin can pivot about the pivot axis 42. The pin 72 is connected to support plates 74, 76 of the pressure roller support 44. The support plates 74 and 76 are arranged in parallel with one another, are interconnected by means of a plurality of connecting elements 78 and are spaced apart from one another.

The support plates 74, 76 are used to rotatably arrange pressure rollers and deflection rollers described below.

Figure 5A:
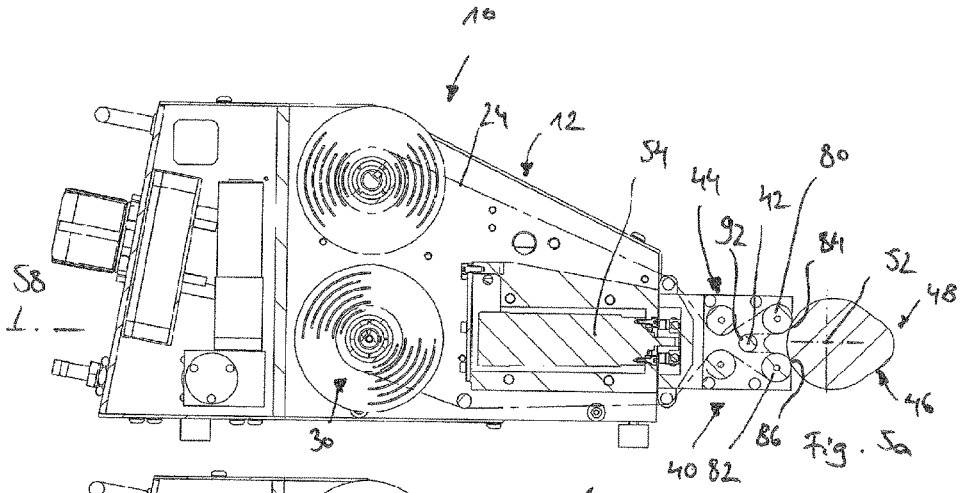
FIGS. 5*a*-5*e* are side views of the finishing belt device according to FIG. 1 during the machining of a cam-shaped peripheral surface of a workpiece.
Figure 5B:
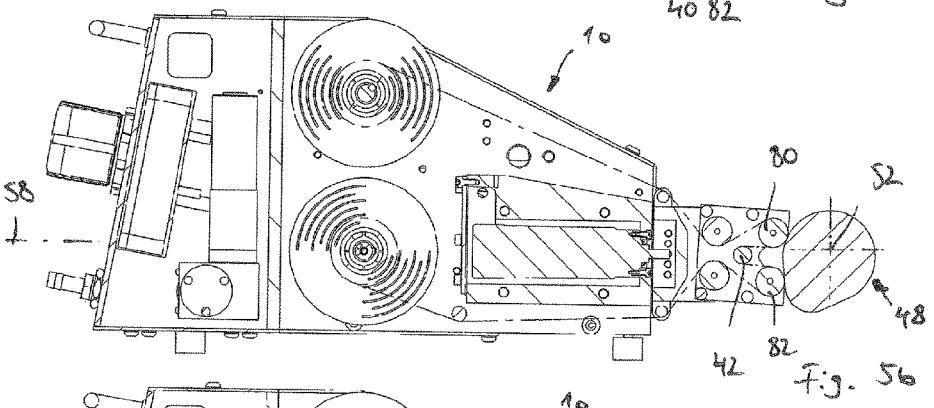
Figure 5C:
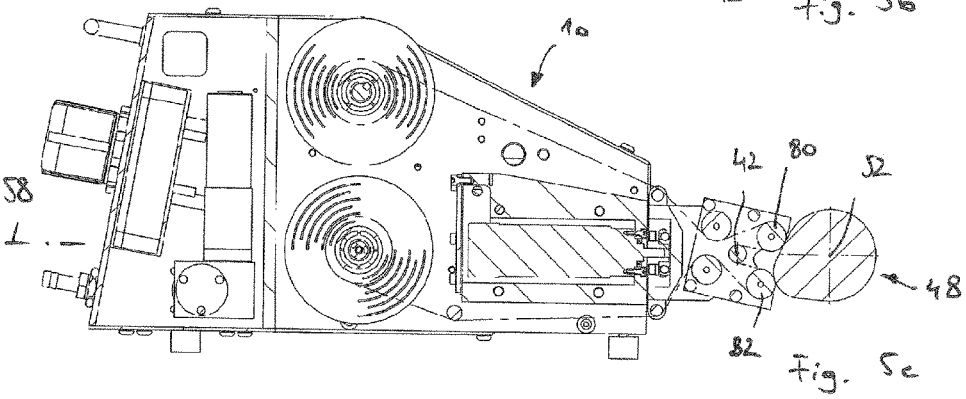
Figure 5D:
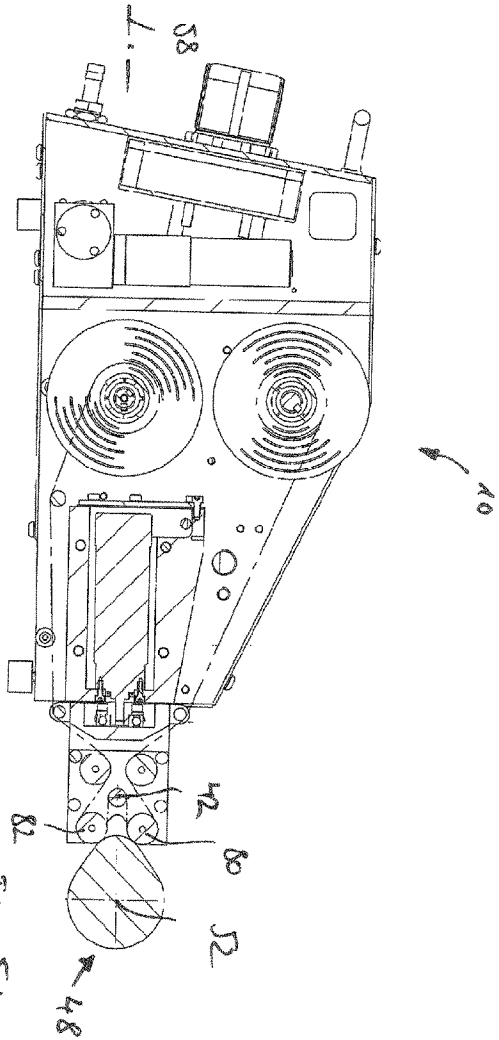
Figure 5E:
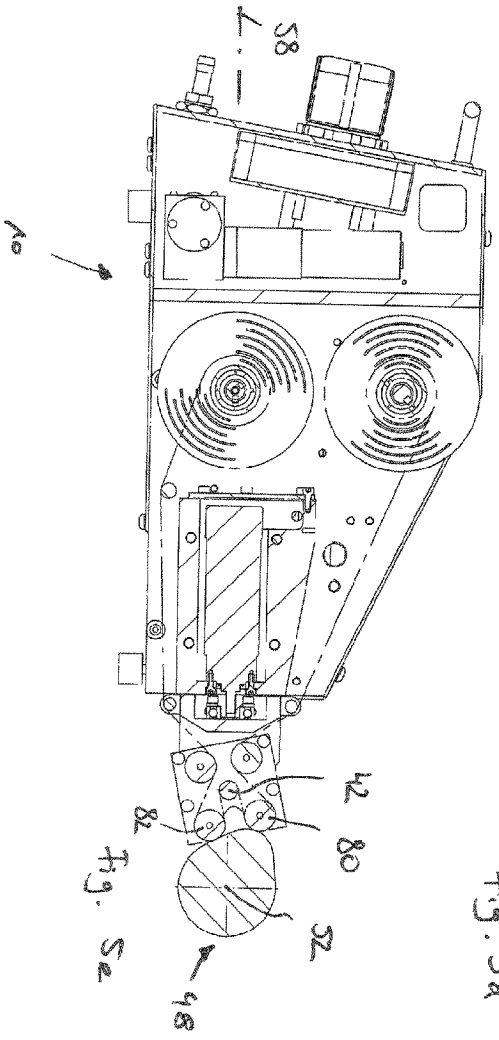

A first pressure roller 80 and a second pressure roller 82 are used to both deflect the finishing belt 24 and to press an active side of the finishing belt 24 against the peripheral surface 46 of the workpiece 48, in each case in a linear contact region 84, 86 (cf. FIG. 5*a*).

The pressure rollers 80, 82 are spaced apart from one another and are held on the pressure roller support 44 so as to be rotatable about mutually parallel axes of rotation 88, 90.

The pressure apparatus 40 further comprises a first deflection roller 92 that acts between the pressure rollers 80 and 82 in the running direction of the finishing belt and is mounted on the pressure roller support 44 so as to be rotatable about an axis of rotation 94. The axis of rotation 94 of the first deflection roller 92 and the pivot axis 42 extend coaxially.

The pressure apparatus 40 comprises further deflection rollers 96 and 98, which are likewise rotatably mounted on the pressure roller support 44.

From the finishing belt supply 18, fresh finishing belt 24 is first guided along the guide rod 66 and fed to the first additional deflection roller 96. The purpose of the deflection roller 96 is to guide the finishing belt 24 towards a central plane 100 before the finishing belt 24 winds around the first pressure roller 80. From the first pressure roller 80, the finishing belt then reaches the first deflection roller 92 and the second pressure roller 82. From there, the finishing belt 24 reaches the second additional deflection roller 98, and from there the guide rod 68 and lastly the finishing belt collection apparatus 20.

While the workpiece 48 is being finished, it is driven about the axis of rotation 52 by means of the rotary drive 50. At the same time, the pressure apparatus 40 is driven in an oscillating manner in a direction parallel to the axis of rotation 52 by means of the oscillating drive 54. In addition, the main support 12 and all the components directly or indirectly connected thereto can move back and forth along the axis 58. Lastly, the pressure roller support 44 is pivotable about the pivot axis 42 relative to the holding portion 38 of the main support 12.

The movements described above are superposed on one another in such a way that, when the workpiece 48 is rotating (cf. FIGS. 5*a* to 5*e*, clockwise rotation of the workpiece 48), the pressure rollers 80 and 82 always exert a pressing force on the rear side of the finishing belt 24 such that an active side of the finishing belt 24 is always in contact with the peripheral surface 46 of the workpiece 48 in two linear contact regions 84 and 86.

Figure 6:
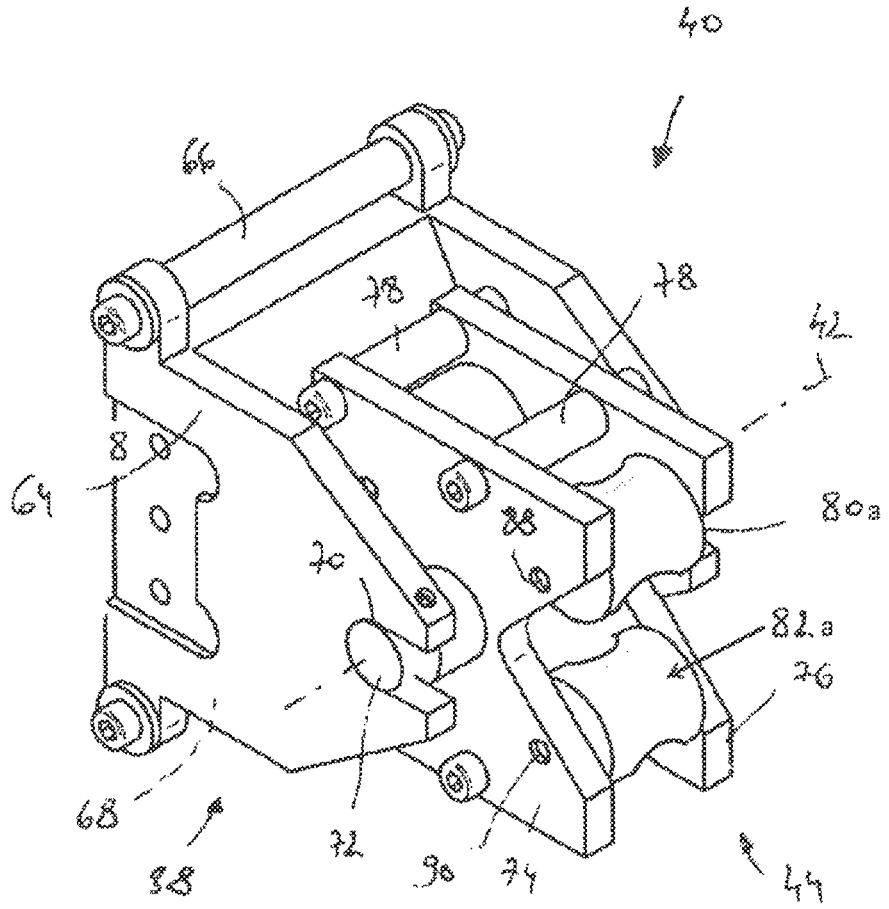
FIG. 6 is a perspective view of a pressure apparatus of the finishing belt device having concave shaped pressure rollers.

FIG. 6 is a perspective view of a pressure apparatus 40 of the finishing belt device having concave shaped pressure rollers 80*a* and 82*a*.

Figure 7A:
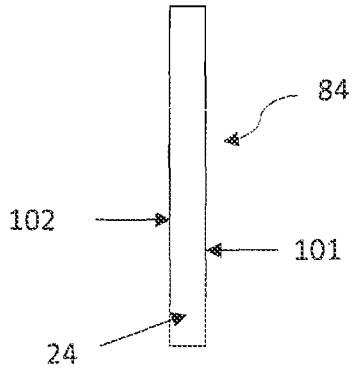
FIGS. 7*a* and 7*b* are cross-sectional views of finishing belt at a linear contact region.
Figure 7B:
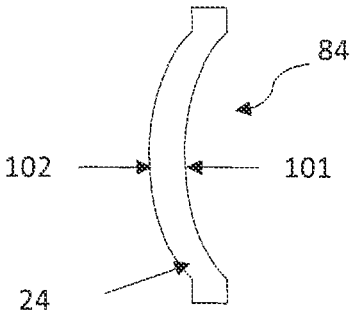

FIGS. 7*a* and 7*b* are cross-sectional views of the finishing belt 24 at the linear contact region 84 viewed from the running direction and perpendicular to the axis of contact of the finishing belt 24 to the workpiece 48.

It is possible for the two linear contact regions 84 and 86 (cf. FIG. 5*a*) to each extend in a straight line (cf. FIG. 7*a*), the lengths of each line corresponding to the width of the finishing belt 24. For this purpose, it is preferable to use circular-cylindrical pressure rollers 80 and 82 (cf. FIG. 3). However, it is also possible for at least one of the pressure rollers 80*a* and 82*a* to have a shape different from a circular-cylindrical shape, in particular a concave shape, such that the corresponding linear contact region 84 of the finishing belt 24 differs from a straight line and in particular has a curved course (cf. FIG. 7*b*).

In this way, peripheral surfaces 46 curved in multiple dimensions can be finished in a simple manner.

In one aspect, the invention contemplates a finishing belt device 10 for finishing a peripheral surface 46 of a workpiece 48, including a finishing belt 24 including a rear side 102 and an active side 101 (cf. FIGS. 3, 5*a*, 6, 7*a*, and 7*b*). A pressure apparatus 40 including a pressure roller 80 or 80*a* is configured to apply a pressing force to the rear side 102 such that, when viewed in the running direction of the finishing belt 24, the active side 101 is pressed against the peripheral surface 46 in a linear contact region 84 at the level of the pressing force. A pressure roller support 44 on which the pressure roller 80 or 80*a* is arranged as a first pressure roller 80 or 80*a* is provided and another pressure roller 82 or 82*a* is arranged as a second pressure roller 82 or 82*a*, such that, when viewed in the running direction of the finishing belt 24, the active side 101 of the finishing belt 24 is pressed against the peripheral surface 46 of the workpiece 48 in two spaced-apart linear contact regions 84 and 86 via the first pressure roller 80 or 80*a* and second pressure roller 82 or 82*a*.

During the machining, fresh finishing belt 24 is continuously fed by the finishing belt conveying apparatus 30 being continuously active.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A finishing belt device for finishing a peripheral surface of a workpiece, comprising:

a finishing belt including a rear side and an active side;

a pressure apparatus including a pressure roller configured to apply a pressing force to the rear side such that, when viewed in the running direction of the finishing belt, the active side is pressed against the peripheral surface in a linear contact region at a level of the pressing force; and a pressure roller support on which the pressure roller is arranged as a first pressure roller and another pressure roller is arranged as a second pressure roller, such that, when viewed in the running direction of the finishing belt, the active side of the finishing belt is pressed against the peripheral surface of the workpiece in two spaced-apart linear contact regions via the first and second pressure rollers, wherein the pressure roller support is held on a main support so as to be rotatable about a pivot axis wherein, when viewed in the running direction of the finishing belt, a first deflection roller is configured to act between the first and second pressure rollers and space the finishing belt apart from the peripheral surface to be finished at the level of the deflection roller.

2. The finishing belt device according to claim 1, wherein the first deflection roller is arranged on the pressure roller support.

3. The finishing belt device according to claim 1, wherein the pivot axis extends in parallel and coaxially with an axis of rotation of the first deflection roller.

4. The finishing belt device according to claim 1, wherein the main support is pressed towards the workpiece along an axis radial to a workpiece axis by a pressing apparatus.

5. The finishing belt device according to claim 1, including at least one additional deflection roller disposed between one or both of a) a finishing belt supply and the first pressure roller and b) between the second pressure roller and a finishing belt collection apparatus in the running direction of the finishing belt.

6. The finishing belt device according to claim 5, wherein the at least one additional deflection roller is arranged on the pressure roller support.

7. The finishing belt device according to claim 5, wherein the at least one additional deflection roller deflects the finishing belt adjacently to or at the height of a plane that extends in parallel with the axes of rotation of the pressure rollers in such a way that the two pressure rollers are arranged on different sides of the plane.

8. The finishing belt device according to claim 7, wherein the two pressure rollers are spaced apart from the plane at least substantially by the same amount.

9. The finishing belt device according to claim 1, including a finishing belt conveying apparatus configured to exert a tensile force on the finishing belt and hold the finishing belt under tension and convey it onwards.

10. The finishing belt device according to claim 9, wherein the finishing belt conveying apparatus is a motor-driven finishing belt collection roller.

11. The finishing belt device according to claim 1, wherein at least one of the pressure rollers has a noncircular-cylindrical shape such that the linear contact region of the finishing belt differs from a straight line.

12. The finishing belt according to claim 1, including a rotary drive configured to rotate the workpiece about an axis of rotation.

13. The finishing belt device according to claim 12, wherein one or both of the pressure roller support and the workpiece to be finished is driven in an oscillating manner in a direction parallel to the axis of rotation by an oscillating drive.

14. A method for finishing a workpiece using a finishing belt device according to claim 1, wherein the active side of the finishing belt is pressed against the peripheral surface, that is to be finished, of the workpiece in two spaced-apart linear contact regions by the two pressure rollers.

15. The method according to claim 14, wherein the finishing belt is continuously conveyed in the running direction of the finishing belt while the peripheral surface is being finished.

16. The method according to claim 14, wherein the workpiece is rotated about an axis of rotation.

17. The method according to claim 16, wherein one or both of the pressure roller holder and the workpiece is driven in an oscillating manner in a direction parallel to the axis of rotation.

18. The finishing belt device according to claim 11, wherein the noncircular-cylindrical shape is a concave or convex shape.

* * * * *